United States Patent [19]

Sevastakis

[11] Patent Number: 4,640,337

[45] Date of Patent: Feb. 3, 1987

[54] CONTINUOUS CASTING APPARATUS

[76] Inventor: Gus Sevastakis, 5645 Angola Rd., Toledo, Ohio 43615

[21] Appl. No.: 729,246

[22] Filed: May 1, 1985

[51] Int. Cl.[4] ..... B22D 11/124

[52] U.S. Cl. ..... 164/443; 164/348

[58] Field of Search ..... 164/443, 485, 348; 165/168

[56] References Cited

U.S. PATENT DOCUMENTS

| | | | |
|---|---|---|---|
| 3,625,498 | 12/1971 | Adamec | 164/443 X |
| 3,853,309 | 12/1974 | Widmer | 165/168 X |
| 4,217,094 | 8/1980 | Crowley | 165/168 X |

*Primary Examiner*—Kuang Y. Lin

*Attorney, Agent, or Firm*—Barnes, Kisselle, Raisch, Choate, Whittemore & Hulbert

[57] ABSTRACT

A continuous casting apparatus comprising a cooler body surrounding a graphite die. Alternatively, the cooler body itself defines the opening through which molten metal is passed. The cooler body has a plurality of integral grooves on an outer surface thereof defining ribs, and a shell or a plate encloses the grooves to define axial passages. The ribs have longitudinally spaced recesses in the form of semicircles on the edge of the ribs and indentations greater than the depth of the rib, whereby coolant moving along the axial passages is subjected to a turbulent flow. The coolant moving along the ribs enters the recesses and indentations and expands from the heat and is forced out to provide a continuous agitation of the coolant flow changing the speed of the moving coolant along the ribs for better heat transfer from the cooler body to coolant liquid. The coolant entering the axial passages from the end of the ribs is subjected to more turbulent flow by entering the enlarged section of the axial passages and more agitation is provided for better heat transfer from the increased cooling area and consequently better results are achieved in the cast products.

9 Claims, 12 Drawing Figures

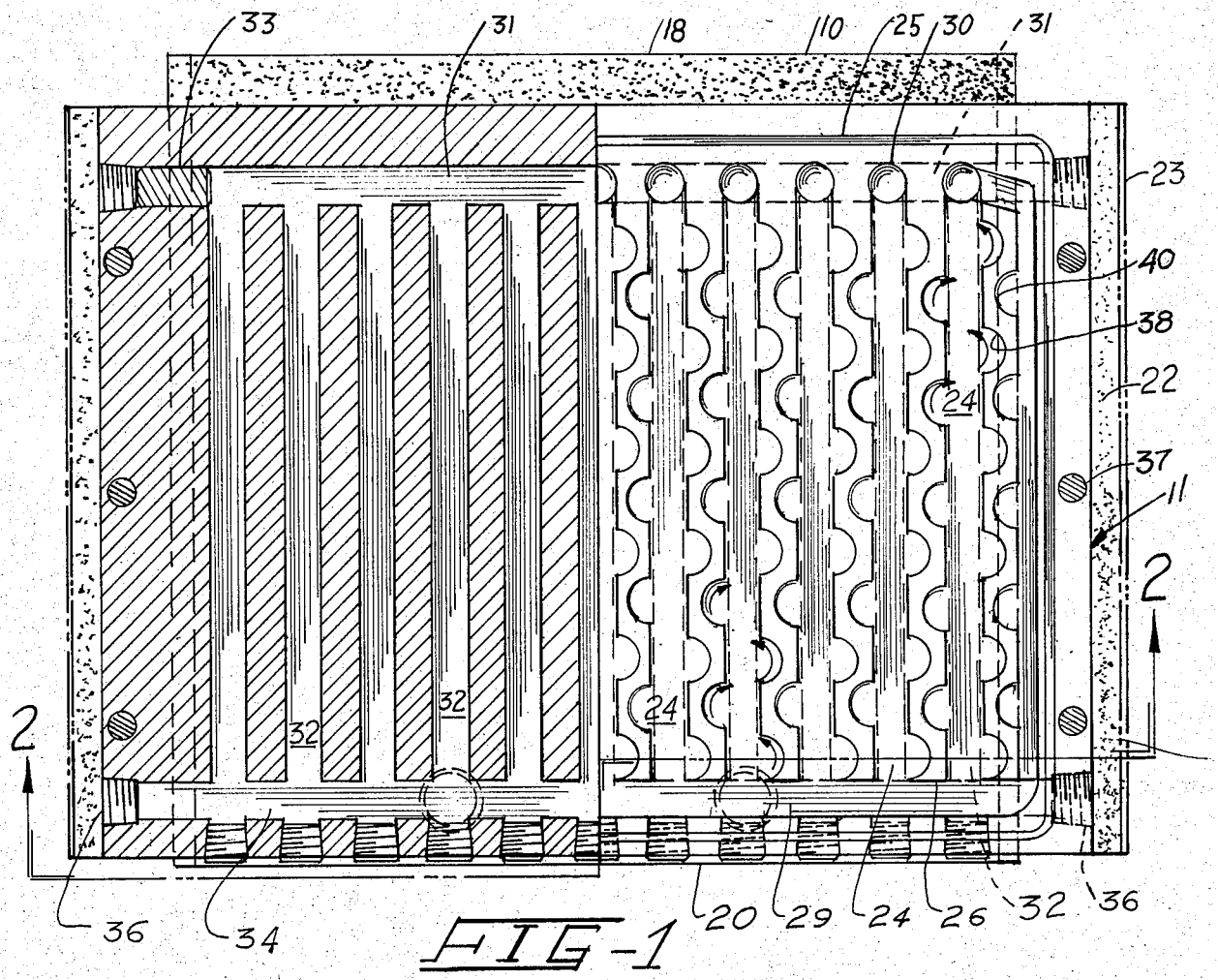
FIG-1
FIG-2
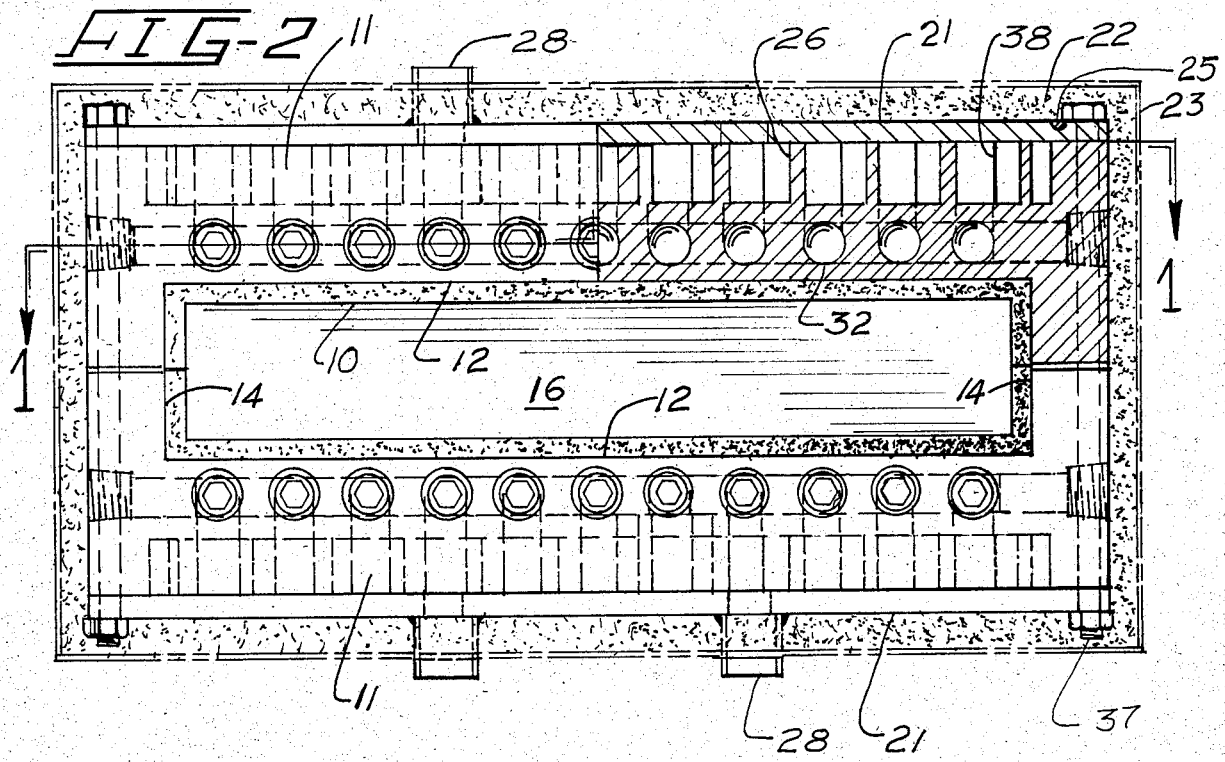

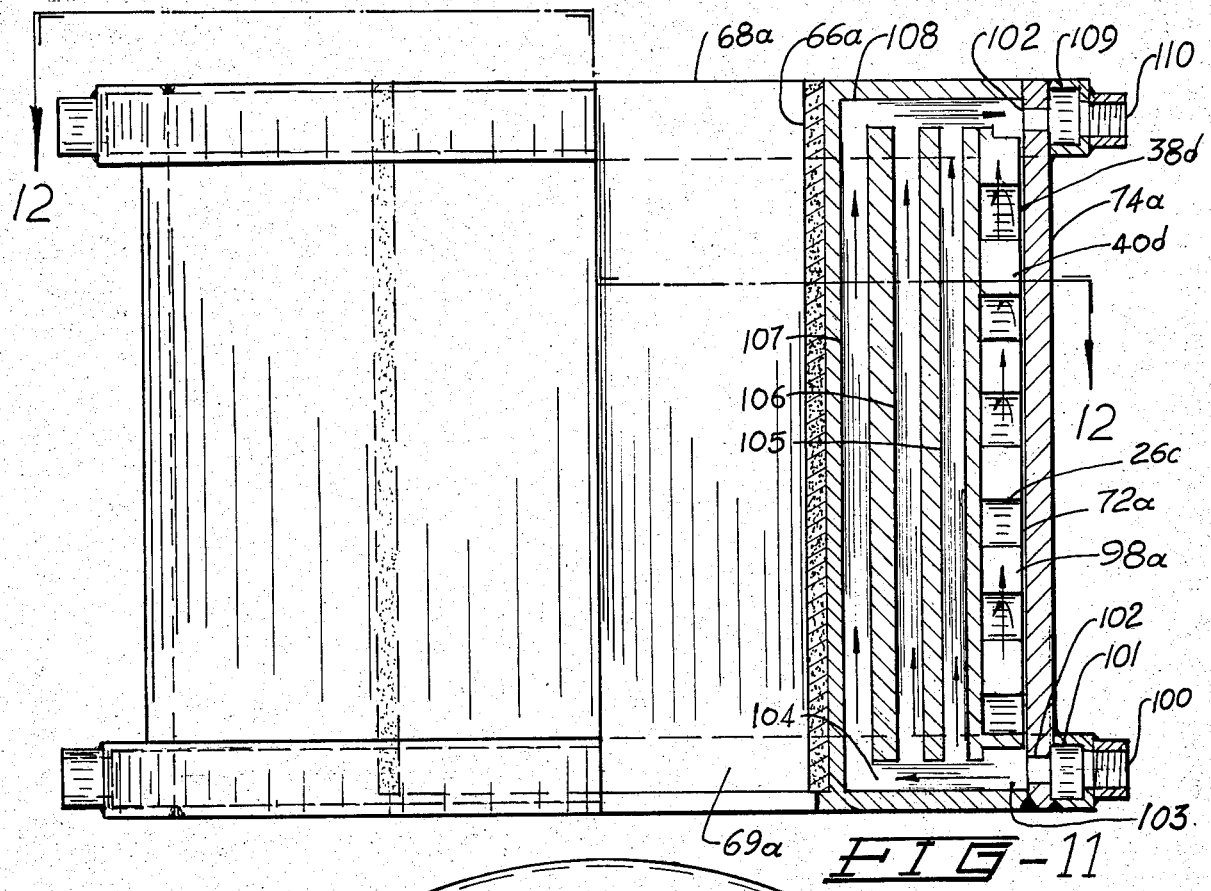
FIG-11
FIG-12
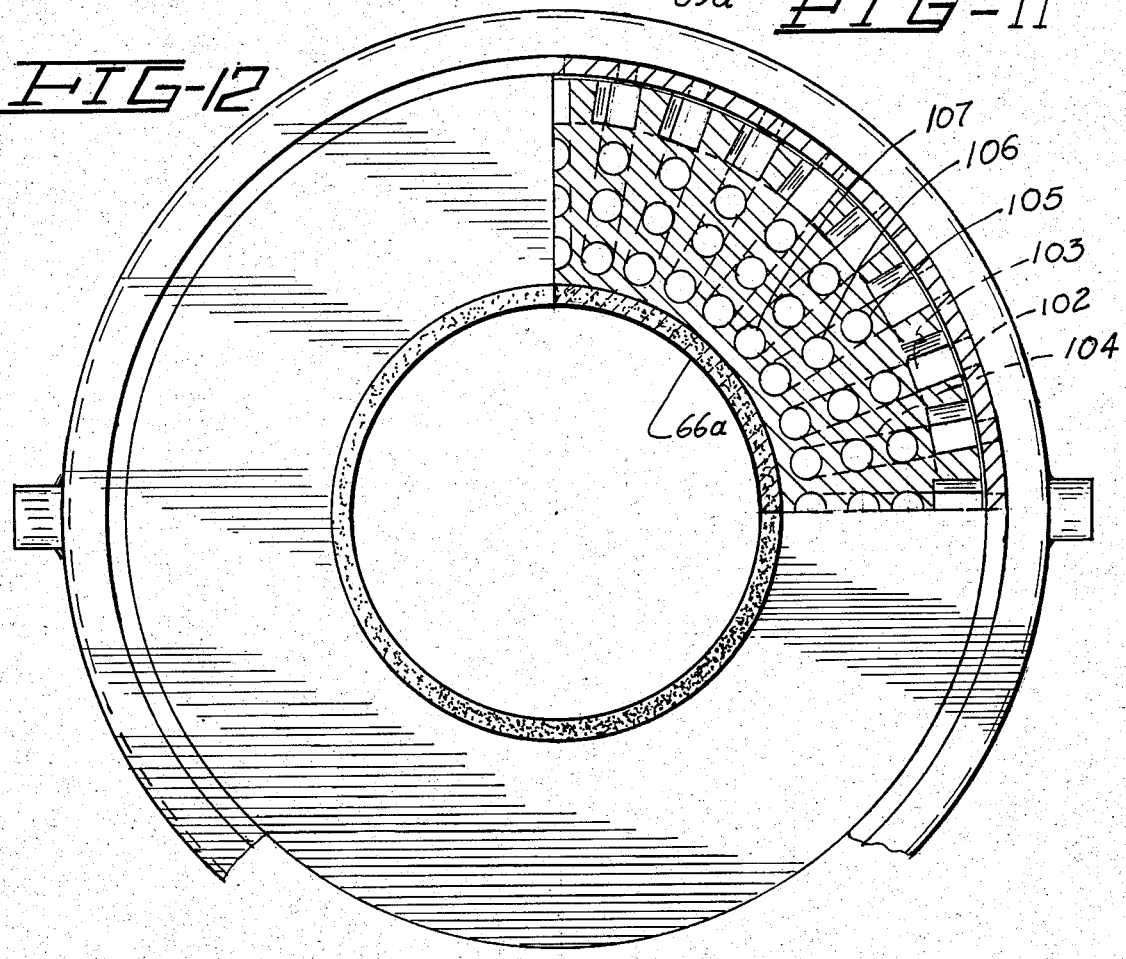

CONTINUOUS CASTING APPARATUS

This invention relates to continuous casting.

BACKGROUND AND SUMMARY OF THE INVENTION

In continuous casting and metals, such as brass and the like, it is common to permit molten metal to flow from a crucible through a die which is surrounded by a cooling apparatus so that the molten metal progressively solidifies and is withdrawn by suitable apparatus. A major consideration in the efficiency of such a device is the ability to remove heat from the die. In order to provide a satisfactory cast product, it is necessary that in the area where the molten metal begins to solidify, commonly known as the freezing zone, a strong outer skin be formed on the outer surface of the product being formed and that the meniscus of the molten metal should be very flat or shallow so that the heat will not be carried further down toward the outlet and tend to re-melt the solidified outer skin adversely affecting the product and possibly resulting in interruption of production.

A prior efficient apparatus for cooling the die utilizes a cooling sleeve having intimate contact with the exterior surface of the die, which cooling sleeve is externally cooled by flowing coolant about the periphery thereof. Inasmuch as the coolant that first contacts the cooling sleeve is cold and progressively increases in temperature, there is a tendency for the cooling sleeve to be cooled unevenly and expand out of intimate contact with the die at that point.

Among the objects of the invention are to provide a novel cooler assembly which provides increased cooling action by facilitating turbulent flow of the cooling liquid, slows the velocity of the coolant and uniformly increases the temperature from the area of intake to exhaust which increases the area of coolant surfaces without sacrificing strength of the cooling sleeve which increased cooling exchange is achieved at a low cost by permitting the coolant to increase in temperature at a unit time; and which invention can be readily adapted to conventional die and cooler assemblies for casting aluminum, copper alloys and all ferrous and non-ferrous metal.

In accordance with the invention, a continuous casting apparatus comprises a cooler body surrounding a graphite die and having a plurality of integral grooves on an outer surface thereof defining ribs, and a shell or a plate enclosing the grooves to define axial passages. The ribs have longitudinally spaced recesses in the form of semicircles on the edges of the ribs and indentations greater than the depth of the rib, whereby coolant moving along the axial passages is subjected to a turbulent flow. The coolant moving along the ribs enters the recesses and indentations and expands from the heat and is forced out to provide a continuous agitation of the coolant flow changing the speed of the moving coolant along the ribs and along the axial passages. The recesses have enlarged cross section or diameter greater than diameter of the axial passages so that coolant entering the enlarged cross sections expands and provides a continuous agitation of the moving coolant, changing the speed of the moving coolant for better heat transfer from the cooler body to the coolant and consequently from the graphite die where it is used and from the product being formed or directly from the product being formed without sacrificing strength of the cooler body.

DESCRIPTION OF THE DRAWINGS

FIG. 1 is a front elevational view of a horizontal continuous casting apparatus embodying the invention taken along the line 1—1 in FIG. 2.

FIG. 2 is a sectional view taken along the line 2—2 in FIG. 1.

FIG. 11 is a part sectional view of another modified form of apparatus.

FIG. 12 is a part sectional view taken along the line 12—12 in FIG. 11.

DESCRIPTION

Figure 3:
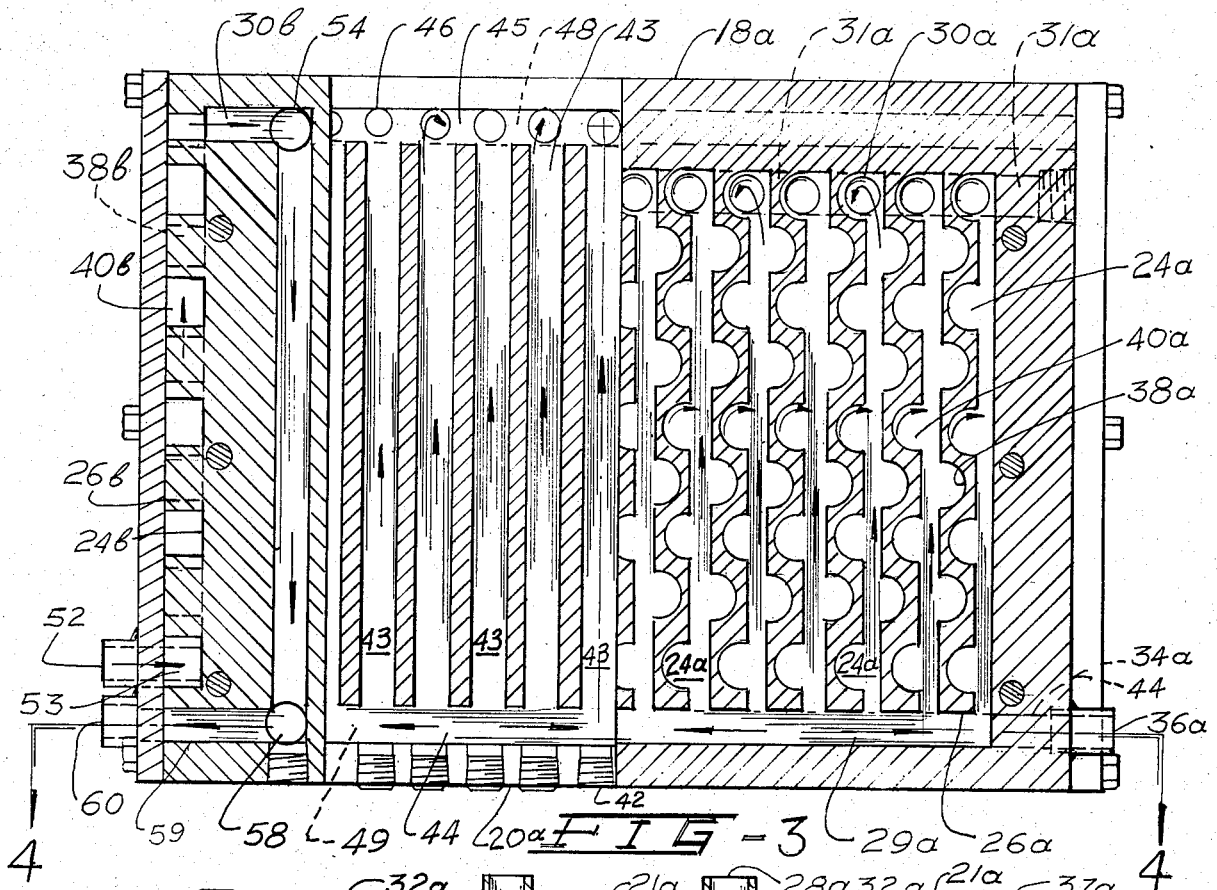
FIG. 3 is a part sectional plan view of a modified form of continuous casting apparatus embodying the invention taken along the line 3—3 in FIG. 4.

Referring to FIGS. 1 and 2, the continuous casting apparatus comprises a graphite die 10 made of two sections held together by a body 11 of a material, such as copper, comprising opposed elongated sections 12 and opposed short sections 14. Die 10 defines an elongated opening 16 into which opening the molten metal is introduced into the end 18 and out of the other end 20 of which solidified material in the form of a cast product which is removed by periodically operated rolls or pulling mechanism in accordance with conventional practice. Refractory material 22 is provided about body 11 and is held in position by a steel protective enclosure 23.

Each of the cooler body sections 11 is formed of a high density, high conductivity metal and includes a row of axial passages 24 for coolant circulation. Cooler body 11 includes a plurality of integral axial ribs 26 on the exterior surface of the cooler body and plates 21 with a rubber seal 25 forming a cover for the ribs to form axial passages 24.

Coolant enters adjacent the exit end of the cavity 16 through inlets 28 and flows through transverse passages 29 to axial passages 24 formed by the edges of the ribs 26 and then through communicating holes 30 and through transverse opening 31, which forms a circulating chamber at the freeze line, to passages 32 to transverse outlet passage 34 and to the outlet 36. Bolts 37 and associated nuts are provided to hold the cooler body 11 during the casting operation, plugs 33 divert the coolant in a proper direction.

In accordance with the invention, each of the axial passages 24 defined by ribs 26 is provided with longitudinally spaced recesses 38, 40 that form a discontinuity promoting continuous agitation of the coolant. Thus, as shown in FIG. 1, the recesses comprise cylindrical machined cavities in the ribs 26 having a circumferential extent of greater than 180° preferably positioned so that the recesses 38 on one side of each rib 26 are staggered with respect to the recesses 40 on other side of ribs 26. As a result, as the coolant flows axially between the ribs 26, it is caused to become agitated first by a recess 38 on one side of the rib and then by a downstream recess 40 on the opposed side of the same passage 24 as shown diagrammatically by the arrows in FIG. 1. The machined cylindrical cavities in the ribs increase the cooling area of the ribs substantially and increase the agitation of the coolant for better heat transfer. This assists in uniformly cooling and avoiding hot spots. The velocity of the coolant passing along the ribs is decreased providing for greater heat transfer. The avoidance of cold spots on the cooler body avoids deformation of the cooler body. All of this contributes to a better molecular structure of the material being cast and an increase in the life of the cooler body. It thus also makes it possible to obtain increase production rates substantially without sacrificing the structural strength of the cooler body and the graphite die.

Due to the agitation of the coolant and the direction of the coolant flow from the exit 20 of the cavity 16 toward the incoming hot metal and the change of direction of flow in the freezing zone of the graphite die as well as the exhaust being in the same direction as the solidified metal flow, cold spots on the cooling sleeve are eliminated and more uniform cooling is achieved throughout the cooling sleeve. Apertures 30 with transverse opening 31 establish the freezing zone on the cast products. The coolant flow from channels 24 to passages 30 and transverse opening 31 to apertures 32 provides a greater impact on the uniformity and rapid formation of the outer skin on the products being cast in the vicinity of the freezing zone. The uniform cooling on the forming sleeve transfer in all transverse directions of axial movement of the cast product results in a rapid solidification of the metal with a stronger outer layer on the cast product at the freezing zone and with greater uniformity throughout the cast body and with a more uniform molecular structure.

Figure 4:
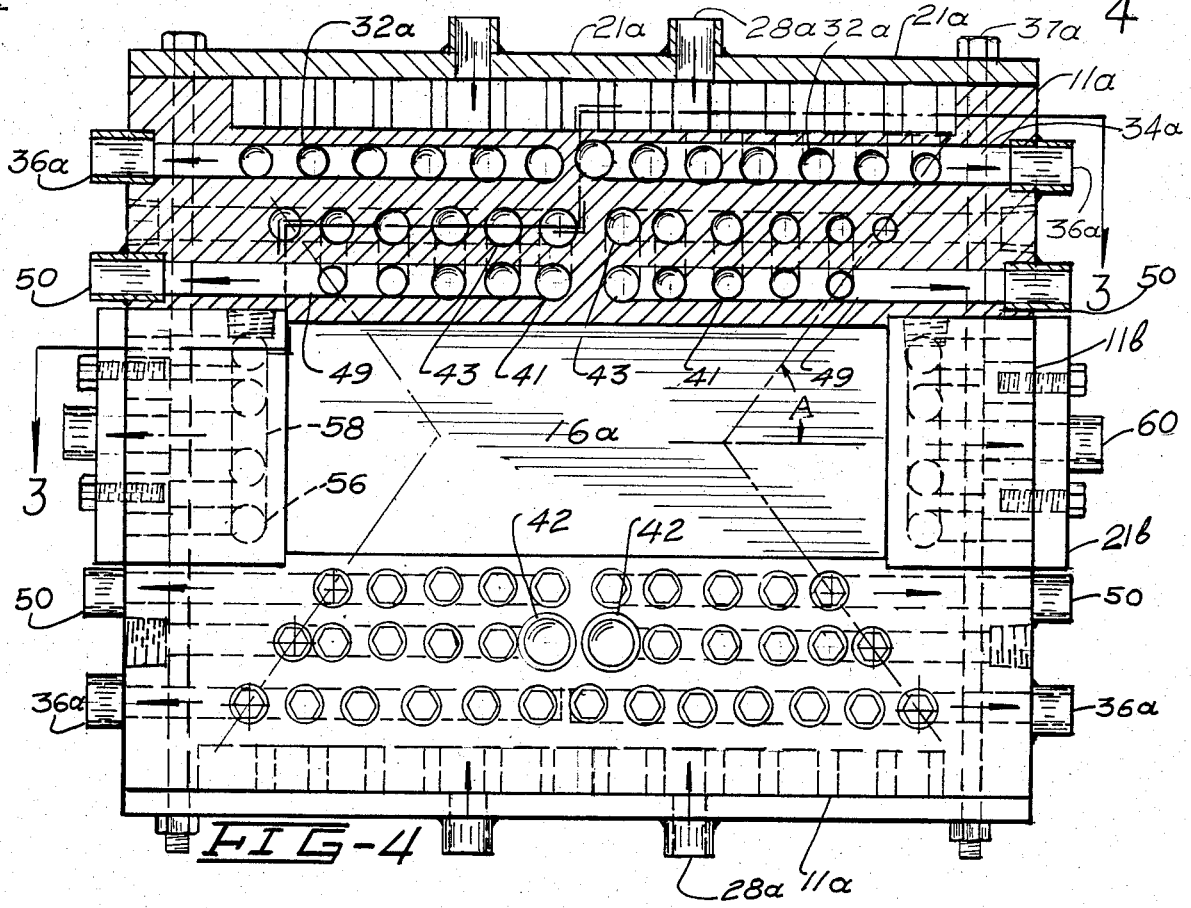
FIG. 4 is a part sectional view taken along the line 4—4 in FIG. 3.

In the form of cooling apparatus set forth in FIGS. 3 and 4, the cooling apparatus comprises bodies **11*a*, 11*b* of a material such as copper made of four sections bolted together to define an opening 16*a* through which the molten metal to be cast is introduced at one end 18*a* and removed at the other end 20*a*. The sections of bodies 11*a* formed with ribs 26*a*, 26*b* closed by plates 21*a*, 21*b* to define axial passages 24*a*, 24*b*. The ribs 26*a* and a row of passages 32*a* form a complete outer cooling band and the inside two rows 41, 43** form an inner cooling band.

For the outer band of cooler body **11*a*, the coolant is supplied through the inlets 28*a* and more specifically as shown in FIGS. 3 and 4. The inlets 28*a* are vertical to the transverse aperture 29*a* and supply coolant to the grooves 24*a* with the semi-cylindrical depressions or recess 38*a* and 40*a* moving the coolant counter to the hot metal movement to the end of the ribs and to the communicating holes 30*a* to transverse opening 31*a* and return through the axial passages 32*a* with the movement of the cast product to the transverse passage 34*a* and to the exit 36*a***.

The inner band of the elongated section has the intakes 42 further away of the casting cavity as shown in FIG. 4. The coolant enters through the intake 42 and flows to the transverse passage 44 to the axial passages 43 and moves counter to the axial movement of the cast product. The outmost end of the axial passage 43 extends to a transverse opening 45 and communicates with passage 46 connecting the transverse passages 48 with the apertures 41 and through the transverse passages 49 to the outlet 50.

The inner band of the elongated section **11*a* is divided into two sections as seen in FIG. 4** for better control of the coolant during the casting operation.

Figure 5:
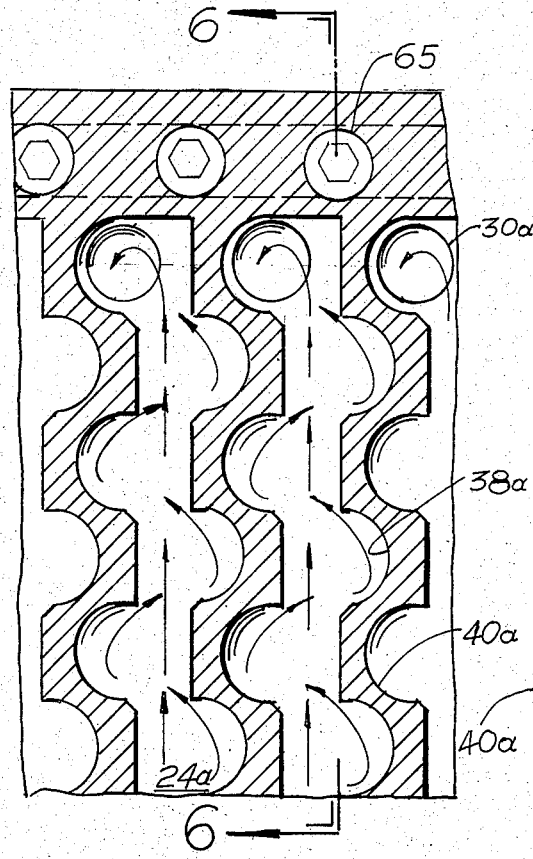
FIG. 5 is a fragmentary sectional view on an enlarged scale of a portion of the apparatus shown in FIG. 3.
Figure 6:
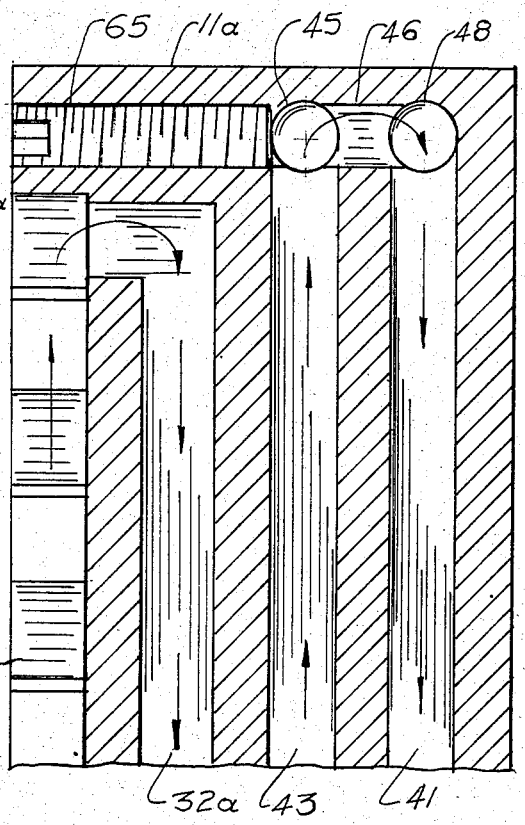
FIG. 6 is a fragmentary sectional view taken along the line 6—6 in FIG. 5.

The arrows in FIGS. 5 and 6 show the circulation of the coolant in the cooler body **11*a***.

The endmost sections **11*b* similarly include one row of axial ribs 26*b* connected by an inlet 52 through transverse opening 53. The semi-cylindrical depressions or recess 38*b* and 40*b* are staggered into axial rib opening. The passages 24*b* with apertures 30*b* connect the transverse opening 54 to axial opening 56 to the transverse opening 58 and through the aperture 59 to the exhaust 60. A cover plate 21*b* forms the rib passages and bolts 37*a*** are provided for the assembly of the cooler body.

Figure 7:
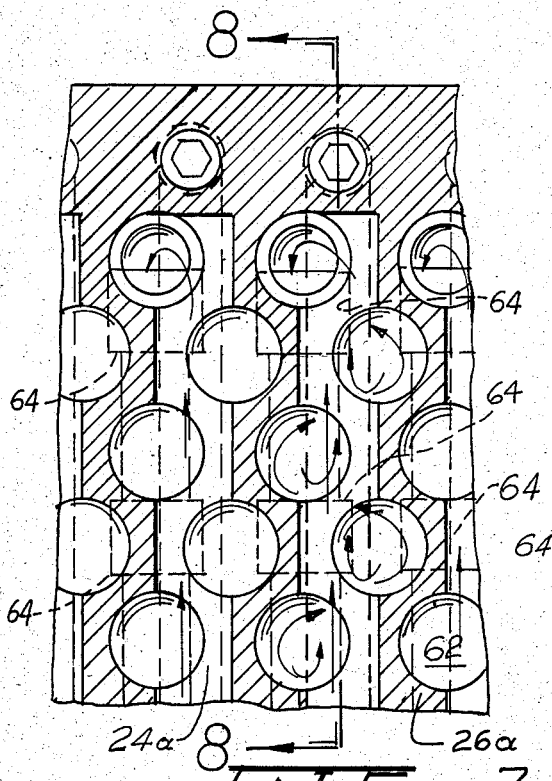
FIG. 7 is a fragmentary sectional view similar to FIG. 5 of a modified form of apparatus.
Figure 8:
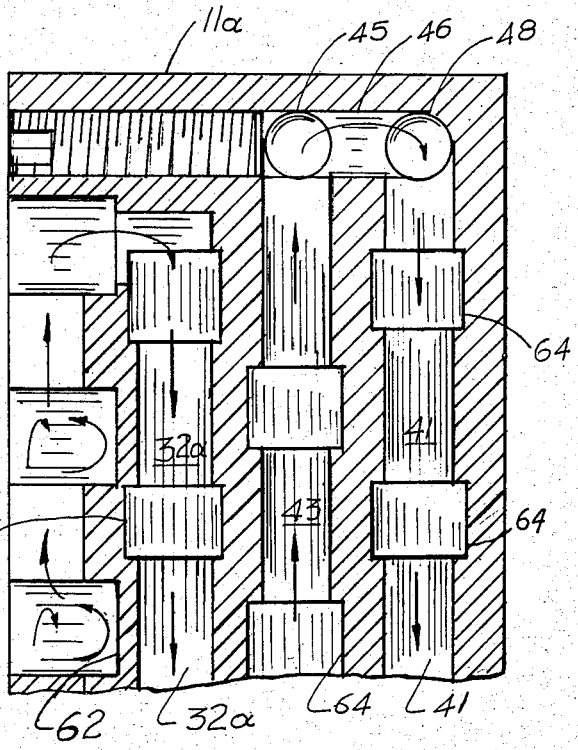
FIG. 8 is a fragmentary sectional view taken along the line 8—8 in FIG. 7.

In order to promote the agitation further, the construction can be modified as shown in FIGS. 7 and 8 wherein additional recesses 62 are provided in the base **24*a* of each groove by extending the machining of the semi-cylindrical depressions or recesses 38*a*, 40*a* into the bare surface 24*a*. As a result, not only is the liquid coolant agitated in a transverse direction as viewed by the arrows in FIG. 5, but also in a plane at a right angle by moving into and out of the pockets or recesses in the base 62 of the grooves 24*a* shown in FIGS. 7 and 8. Additional enlarged radial recesses 64 are provided in association with apertures 41, 43 and 32*a* to reduce the velocity of coolant flow and provide a greater area on the inside or inner cooling band without sacrificing the strength of the cooler body, as shown in FIGS. 7 and 8**.

The transverse opening 45, the apertures 46 and transverse opening 48 establish the freezing zone of the cast products. Plugs 65 are provided to direct the coolant in the proper direction. The axial passages 41, 43, **32*a* and the passage 24*a*** form an angle A with the horizontal axis of the die cavity to avoid premature freezing at the corners of the cast products.

Figure 9:
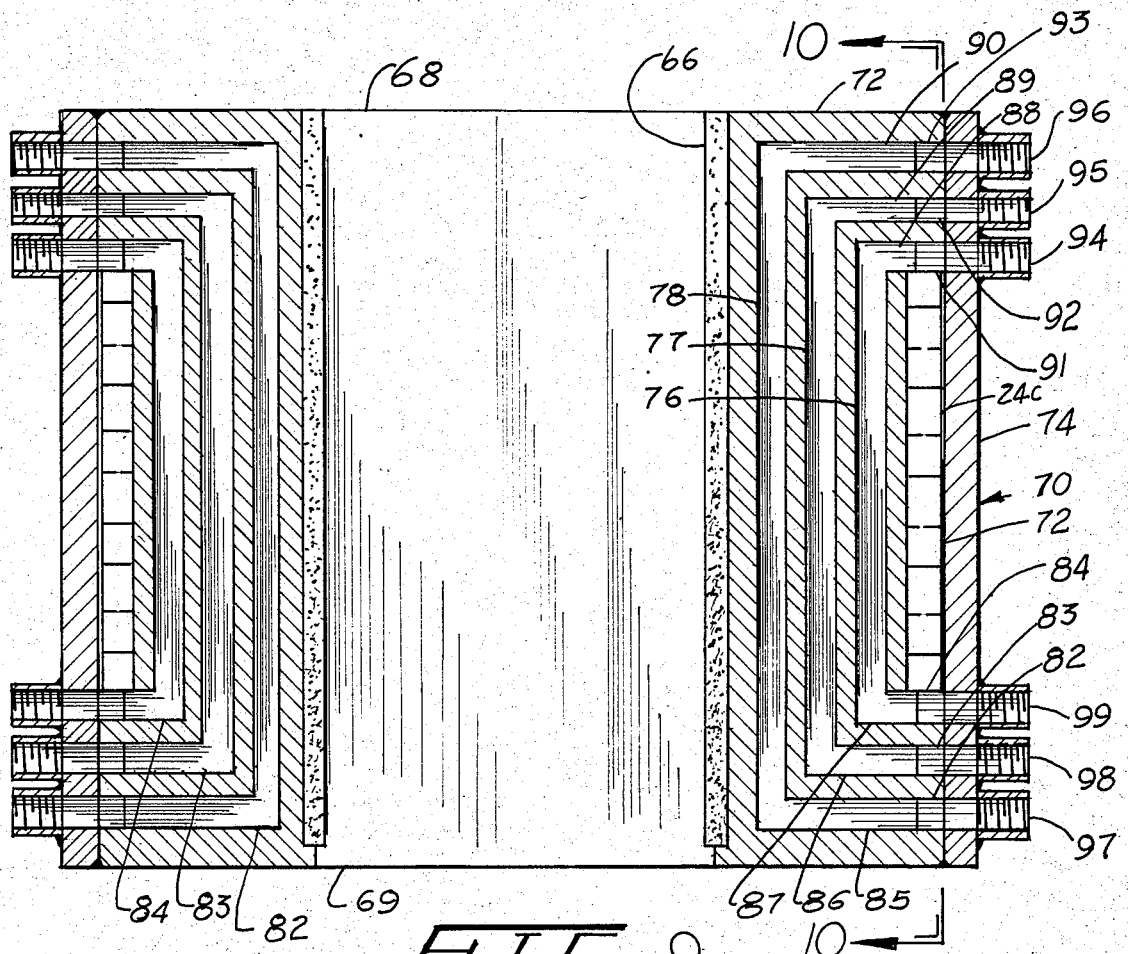
FIG. 9 is a part sectional elevational view of another modified form of apparatus.
Figure 10:
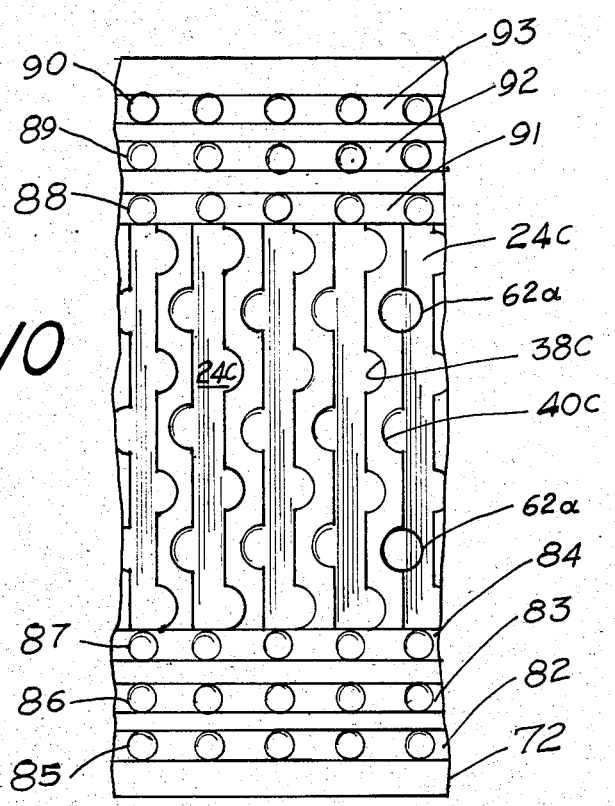
FIG. 10 is a fragmentary sectional view taken along the line 10—10 in FIG. 9.

The invention is also applicable to circular cooling apparatus such as shown in FIGS. 9 and 10 wherein a graphite die 66 is provided with an inlet 68 and an outlet 69 and surrounded by a cooling apparatus 70 including a cooler body 72 which is cylindrical and fits within a shell 74. Each row of axial passages has a radial passage connected to a plenum having at least one inlet and one outlet. More specifically, as shown in FIG. 9, each axial passage 76, 77, 78 has a radial passage 85, 86, 87, respectively, connected to the respective plenum 82, 83, 84 and inlets 97, 98, 99 to control flow of the coolant in the respective axial passages. The other end of the axial passages 76, 77, 78 near the inlet of the molten metal to the graphite die 66 are connected by radial apertures 88, 89, 90 to the upper plenums 91, 92, 93, respectively, and, in turn, to coolant outlets 94, 95, 96, respectively. The outermost surface of the cooler body is formed with a plurality of grooves **24*c* defining ribs 26*c* and the ribs are formed with semi-cylindrical recesses 38*c*, 40*c* that are staggered, as discussed above in connection with the form shown in FIGS. 5–8. Additional recesses 62*a* at a right angle with the base 24*c* of the ribs 26*c* may be formed as shown in FIGS. 7 and 8**.

The invention is also applicable to another circular cooling apparatus such as shown in FIGS. 11 and 12 wherein a graphite die **66*a* is provided with an inlet 68*a* and outlet 69*a*. The cooler body 72*a* is enclosed by a shell 74***a*. At least one inlet 100 for coolant is provided near the exit side of graphite die 66*a*. The inlet 100 connected to the plenum 101 and through the aperture 102 to the circulating chamber 103 to the radial apertures 104. The axial apertures 105, 106, 107 and the ribs 26*c* have a common lower circulating chamber 103. The other end of axial apertures 105, 106, 107 are connected to a radial aperture 108 and through the opening 102 to the circulating chamber 109 and to the exhaust 110. Ribs 26*c* and semi-cylindrical recesses 38*d*, 40*d* are formed as shown in FIG. 10.

I claim:

1. A continuous casting apparatus comprising a coolant body having an elongated opening into one end of which molten metal is introduced and out of the other end of which solidified metal is removed, said body having an outer surface, a plurality of grooves on said outer surface defining spaced ribs, a plate closing said grooves to define axial passages between the ribs, an inlet in said coolant body for supplying coolant communicating with said axial passages, an outlet in said coolant body for removing coolant communicating with said axial passages such that coolant flows continuously through said axial passages, said ribs having side walls, said ribs having longitudinally spaced oppositely facing recess in said side walls defining a radial enlargement whereby coolant moving along said axial passages is subjected to a turbulent flow, said recesses are substantially cylindrical in a direction transverse to the ribs, said recesses on one side of one rib being staggered longitudinally with respect to the recesses on the adjacent side of the adjacent rib such that the coolant is subject, in addition, to a sinuous flow from a recess in one side wall of one rib to a recess of an opposite side wall of an adjacent rib.

2. The apparatus set forth in claim 1 wherein said body includes a plurality of secondary cylindrical recesses partially in the base of the grooves of at least some of the grooves.

3. The apparatus set forth in claim 1 including an additional passage in the coolant body extending parallel to said first mentioned passage, and cylindrical recesses having enlarged radial sections on the same center line with the said additional passage to create turbulence throughout the additional passages.

4. The apparatus set forth in claim 1 wherein said body comprises four sections joined together to define a non-circular opening.

5. The apparatus set forth in claim 1 wherein said body is generally circular and includes an array of grooves about the periphery thereof.

6. The apparatus set forth in claim 1 including a graphite die associated with said cooler body.

7. The apparatus set forth in any of claims 1, 2, 3, 4, 5 and 6 wherein said cooler body is rectangular and has a rectangular opening into which molten metal is introduced.

8. The apparatus set forth in any of claims 1, 2, 3, 4, 5 and 6 wherein said cooler body is circular and has a circular opening into which molten metal is introduced.

9. The apparatus set forth in any of claims 1, 2, 3, 4, 5 and 6 wherein the cooler body is circular and includes a set of the axial apertures have a common radial aperture to supply coolant through the cooler body.

* * * * *